US005531837A

United States Patent [19]

Ohashi et al.

[11] Patent Number: 5,531,837

[45] Date of Patent: Jul. 2, 1996

[54] METHOD FOR INCREASING OXIDATION RESISTANCE OF FE-CR-AL ALLOY

[75] Inventors: Tsuneaki Ohashi, Ohgaki; Nobuo Tsuno, Kasugai; Teruhisa Kurokawa, Ama-gun, all of Japan

[73] Assignee: NGK Insulators, Ltd., Nagoya, Japan

[21] Appl. No.: 213,507

[22] Filed: Mar. 16, 1994

[30] Foreign Application Priority Data

Mar. 25, 1993 [JP] Japan ..... 5-090883

[51] Int. Cl.[6] ..... C23C 8/10; C23C 8/14; C22C 38/06

[52] U.S. Cl. ..... 148/280; 148/285

[58] Field of Search ..... 148/285, 280; 428/472.2

[56] References Cited

U.S. PATENT DOCUMENTS

| | | | |
|---|---|---|---|
| 2,269,601 | 1/1942 | Perrin | 148/280 |
| 4,439,248 | 3/1984 | Herchenoeder | 148/280 |
| 4,588,449 | 5/1986 | Sigler | 148/6.35 |

FOREIGN PATENT DOCUMENTS

| | | |
|---|---|---|
| 0393581A2 | 10/1990 | European Pat. Off. . |
| 1226734 | 7/1960 | France . |
| 4-63148 | 10/1992 | Japan . |
| 2001677 | 2/1979 | United Kingdom . |
| 2094656 | 9/1982 | United Kingdom . |
| 2160892 | 1/1986 | United Kingdom . |

OTHER PUBLICATIONS

Patent Abstracts of Japan, vol. 12, No. 438, JP–A 63–162502 (A), Jul. 5, 1988.

Patent Abstracts of Japan, vol. 8, No. 67, JP–A 58–217677 (A), Dec. 17, 1983.

"Oxide Structure of Stainless Steels under Controlled Oxygen Atmospheres", Toshiyuki Yashiro, Heat Treatment, vol. 31, No. 4, pp. 205–211, 1991.

"Surface Modification of Stainless Steels Using Thermal Passivation", Toshiyuki Yashiro et al., Surface Technology vol. 41, No. 3, pp. 41–48, 1990.

*Primary Examiner*—Sam Silverberg

*Attorney, Agent, or Firm*—Ronald J. Kubovcik

[57] ABSTRACT

A method for increasing the oxidation resistance of a Fe-Cr-Al alloy, which comprises placing said Fe-Cr-Al alloy in an atmosphere having an oxygen partial atmosphere of 0.02–2 Pa at a temperature of 950°–1,200° C. to form, on the surface of said alloy, an alumina-based protective film having excellent oxidation resistance.

Said method enables the formation of a homogeneous protective film having excellent oxidation resistance, even on alloys having non-homogeneous compositions, such as Fe-Cr-Al alloy and the like, and is very effective for increasing the oxidation resistance of Fe-Cr-Al alloy.

7 Claims, 2 Drawing Sheets

METHOD FOR INCREASING OXIDATION RESISTANCE OF FE-CR-AL ALLOY

BACKGROUND OF THE INVENTION

1. Field of the Invention

The present invention relates to a method for increasing the oxidation resistance of a Fe-Cr-Al alloy by forming a protective film of excellent oxidation resistance on the surface of said alloy.

2. Description of the Prior Art

In order to increase the oxidation resistance of a metal, it is generally known to form an oxidation-resistant protective film on the surface of the metal.

For example, an article "Oxide Structure of Stainless Steels under Controlled Oxygen Atmospheres" (Toshiyuki Yashiro, "Heat Treatment", Vol. 31, No. 4, pp. 205–211, 1991) and an article "Surface Modification of Stainless Steels Using Thermal Passivation" (Toshiyuki Yashiro, Keiichi Terashima, Taketomo Yamazaki, "Surface Technology", Vol. 41, No. 3, pp. 41–48, 1990) report a method for increasing the corrosion resistance of stainless steel or the like, which comprises heat-treating stainless steel or the like in a low-pressure oxygen or a controlled atmosphere to form a passive oxide film on the surface.

Also, Japanese Patent Publication No. 63148/1992 discloses a method for forming an alumina film on the surface of a TiAl intermetallic compound, which comprises placing said compound in an atmosphere having an oxygen partial pressure of $1\times10^{-2}$ to $1\times10^{-5}$ Pa at 900°–1,050° C. for 30 minutes to 100 hours to oxidize only Al selectively.

The above prior art is used for stainless steel or the like, or a TiAl intermetallic compound. When used for a Fe-Cr-Al alloy, however, the prior art has been unable to form a homogeneous protective film (an alumina film) because the pressure employed during film formation is too low ($-10^{-2}$ Pa or lower).

SUMMARY OF THE INVENTION

Under such a situation, the present invention has been made in order to provide a method capable of forming a homogeneous protective film of excellent oxidation resistance even on a metal having a non-homogeneous composition, such as Fe-Cr-Al alloy or the like.

The present invention provides a method for increasing the oxidation resistance of a Fe-Cr-Al alloy, which comprises placing said Fe-Cr-Al alloy in an atmosphere having an oxygen partial atmosphere of 0.02–2 Pa at a temperature of 950°–1,200° C. to form, on the surface of said alloy, an alumina-based protective film having excellent oxidation resistance.

The present invention further provides a method for increasing the oxidation resistance of a Fe-Cr-Al alloy, which comprises placing said Fe-Cr-Al alloy in an air having a pressure of 0.1–10 Pa at a temperature of 950°–1,200° C. to form, on the surface of said alloy, an alumina-based protective film having excellent oxidation resistance.

The present invention furthermore provides a Fe-Cr-Al alloy having excellent oxidation resistance, which has an alumina-based dense protective film on the surface and wherein an yttrium component is enriched in said protective film.

DETAILED DESCRIPTION OF THE INVENTION

Figure 1:
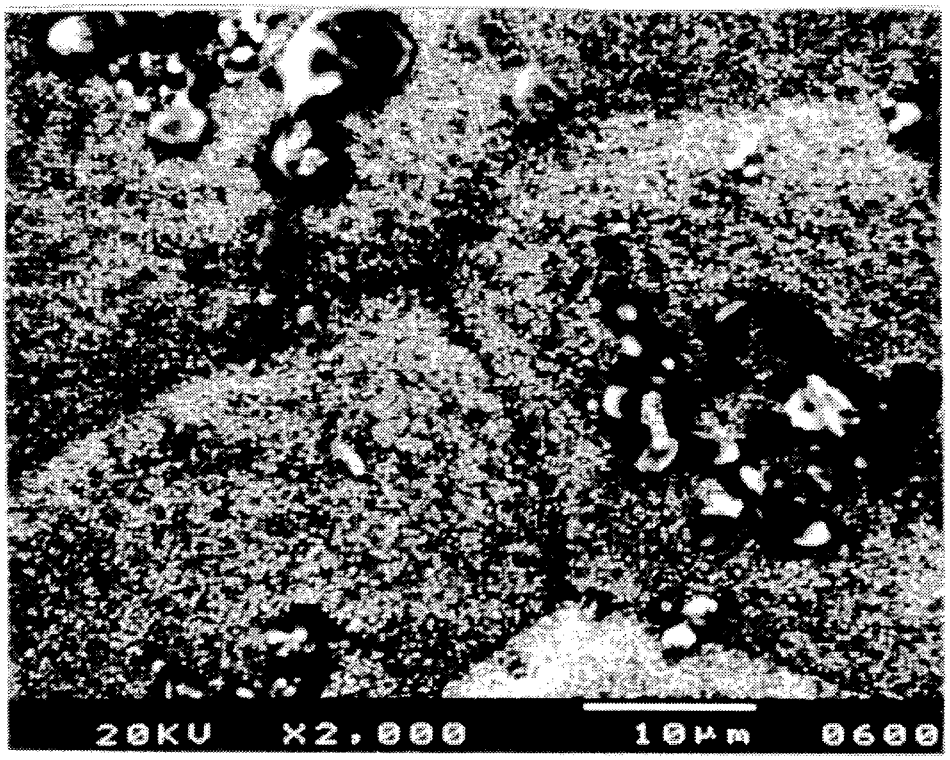
FIG. 1 is an electron micrograph (a secondary electron image) of the surface of the sample after heat treatment under reduced pressure, of Example 5.

In the method of the present invention, a Fe-Cr-Al alloy is heat-treated in an atmosphere having an oxygen partial pressure of 0.02–2 Pa at a temperature of 950°–1,200° C. to form an oxidation-resistant protective film on the surface of said alloy. The heat treatment is conducted, for example, in an air having a reduced pressure of 0.1–10 Pa at 950°–1,200° C. By conducting such a heat treatment under reduced pressure, a dense, homogeneous, crack-free protective film (an alumina film) can be formed without being contaminated by undesirable components, and the resulting Fe-Cr-Al alloy having said protective film on the surface has increased oxidation resistance. When the present method is applied to an yttrium-containing Fe-Cr-Al alloy, it has been found that in the resulting alloy having a protective film on the surface, yttrium is enriched in or near said protective film. Yttrium imparts improved adhesivity to the protective film and is therefore presumed to give a favorable effect to the increased oxidation resistance of Fe-Cr-Al alloy. The above-mentioned oxygen partial pressure is preferably achieved by making the system vacuum, but it may be obtained by allowing an inert gas (e.g. argon or nitrogen) to contain a small amount of oxygen.

In the present invention, the pressure of the atmosphere is 0.1–10 Pa, for the following reasons. When the pressure is lower than 0.1Pa, Cr vaporizes in a large amount, making difficult the formation of an alumina protective film; when the pressure is higher than 10 Pa, the alumina protective film formed has a number of cracks and, when the Fe-Cr-Al alloy as starting material contains yttrium, the enrichment of yttrium in or near the surface protective film is insufficient and the protective film has low adhesivity as compared with when the yttrium enrichment is sufficient. The pressure of the atmosphere is preferably 0.1–7 Pa because a homogeneous film is obtainable. These results were obtained from the experiments in an air of reduced pressure, etc. The pressure range of the atmosphere in the present invention is 0.02–2 Pa in terms of oxygen partial pressure.

In the present invention, the temperature of the heat treatment is 950°–1,200° C. for the following reasons. When the temperature is lower than 950° C., the rate of alumina film formation is small and the formation of a homogeneous film is difficult; when the temperature is higher than 1,200° C., film formation is easily affected by the vaporization of alloy components and the formation of a homogeneous film is difficult as well.

When the temperature is lower than 1,060° C., contamination by the tungsten, etc. contained in the furnace used, etc. occurs easily during the heat treatment under reduced pressure, and this may give an adverse effect on the oxidation resistance of the resulting Fe-Cr-Al alloy. Hence, the temperature of the heat treatment is preferably 1,060°–1,200° C.

The time for which the Fe-Cr-Al alloy is heat-treated under reduced pressure, varies depending upon the temperature employed, etc. but about 5–15 hours is preferred generally. Satisfactory increase in oxidation resistance is obtained by determining the time for heat treatment under reduced pressure so that the weight increase per unit surface area (hereinafter referred to as "pre oxidation amount") by heat treatment under reduced pressure becomes 0.20 $mg/cm^2$ or less, preferably 0.06–0.15 $mg/cm^2$.

When a Fe-Cr-Al alloy is subjected to the abovementioned heat treatment under reduced pressure, the resulting alloy has an alumina-based dense protective film on the surface and has increased oxidation resistance. When an yttrium-containing Fe-Cr-Al alloy is subjected to the same treatment, the resulting alloy contains yttrium in the formed protective film in an enriched state and has even higher oxidation resistance because yttrium imparts higher adhesivity to the protective film.

The present invention is described in more detail below by way of Examples. However, the present invention is not restricted to these Examples.

In the following Examples, the test items were measured as follows.

[Pressure (Pa)]

Was measured using a Pirani gage or an ionization gage.

[Temperature (°C.)]

Was measured using an R thermocouple thermometer specified by JIS.

[Pre oxidation amount ($mg/cm^2$)]

Weight increase per unit surface area, of a sample after heat treatment under reduced pressure was calculated using the following formula (1):

$$(W_1-W_0)/S \quad (1)$$

wherein $W_1$=weight of sample after heat treatment under reduced pressure, $W_0$=weight of sample before heat treatment under reduced pressure, and S=surface area of sample.

[Total oxidation amount ($mg/cm^2$)]

Was calculated using the following formula (2) after conducting an oxidation test of placing a sample in air at 1,100° C. for 150 hours:

$$(W_2-W_0)/S \quad (2)$$

wherein $W_2$= weight of sample after oxidation test, $W_0$= weight of sample before heat treatment under reduced pressure, and S= surface area of sample.

[Homogeneity of oxide film (presence of non-homogeneous portions in oxide film)]

The surface of an oxide film formed by heat treatment under reduced pressure was observed using a scanning type electron microscope, and the homogeneity of the film was evaluated according to the density of the back scattered electron image obtained and the presence of non-homogeneous portions (portions of high density) was examined. (It is known that heavy elements such as Fe, Cr and the like, as compared with light elements such as Al and the like, give a back scattered electron of higher intensity. Therefore, when a non-homogeneous alumina film is formed, the back scattered electron image of said film has different densities, whereby the homogeneity of the film can be evaluated.)

[Cracks in oxide film]

The surface of an oxide film formed by heat treatment under reduced pressure was observed using a scanning type electron microscope, and the presence of the cracks having a length of 5 μm or more seen in the secondary electron image was examined.

[Yttrium amount in oxide film]

The surface of a sample after heat treatment under reduced pressure and the inside of said sample exposed by argon etching (100 minutes) were measured for respective yttrium amounts, using the spectral peak intensity (counts per second, CPS) of Y 3 d electrons obtained by electron spectroscopy for chemical analysis. When the ratio of the yttrium amount(C) in or near the film and the yttrium amount (B) of the surface, i.e. (C/B) was 1.5 or more, it was judged that yttrium was enriched in or near film.

[Tungsten peak in oxide film]

The surface of a sample after heat treatment under reduced pressure was measured for the spectral peak intensity of W 4 d electrons by electron spectroscopy for chemical analysis. The peak intensity was rated in the three scales of n (not present), w (weak) and s (strong).

EXAMPLES 1–6 AND COMPARATIVE EXAMPLES 1–6

A pure Fe powder, a pure Cr powder, a Fe-Al (Al:50% by weight) alloy powder, a Fe-B (B:20% by weight) alloy powder and a $Y_2O_3$ powder were mixed so as to give a composition A shown in Table 1. The mixture was mixed with an organic binder and water. The resulting mixture was kneaded and passed through an extrusion die to form a honeycomb structure of 100 mm in diameter, 100 μm in rib thickness and 500 cells/in.$^2$ in cell density. The honeycomb structure was dried and then sintered in a hydrogen atmosphere at 1,350° C. for 2 hours to obtain a sintered honeycomb material. The shrinkage factor on firing was 17%. The sintered honeycomb material was subjected to chemical analysis, which gave a carbon content of 0.21% by weight.

Figure 3:
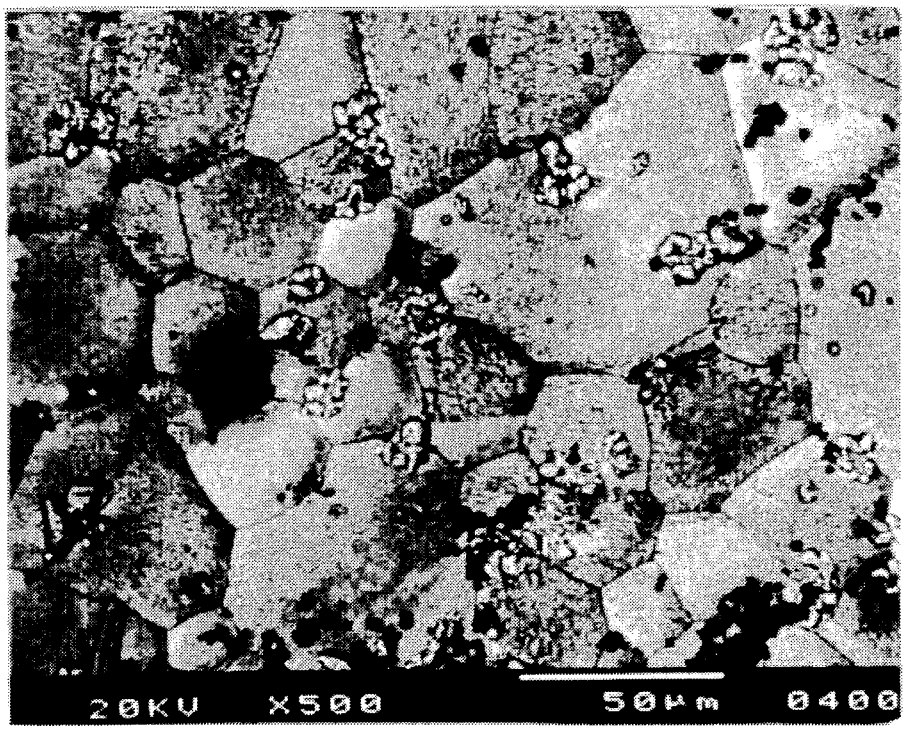
FIG. 3 is an electron micrograph (a back scattered electron image) of the surface of the sample after heat treatment under reduced pressure, of Example 4.
Figure 4:
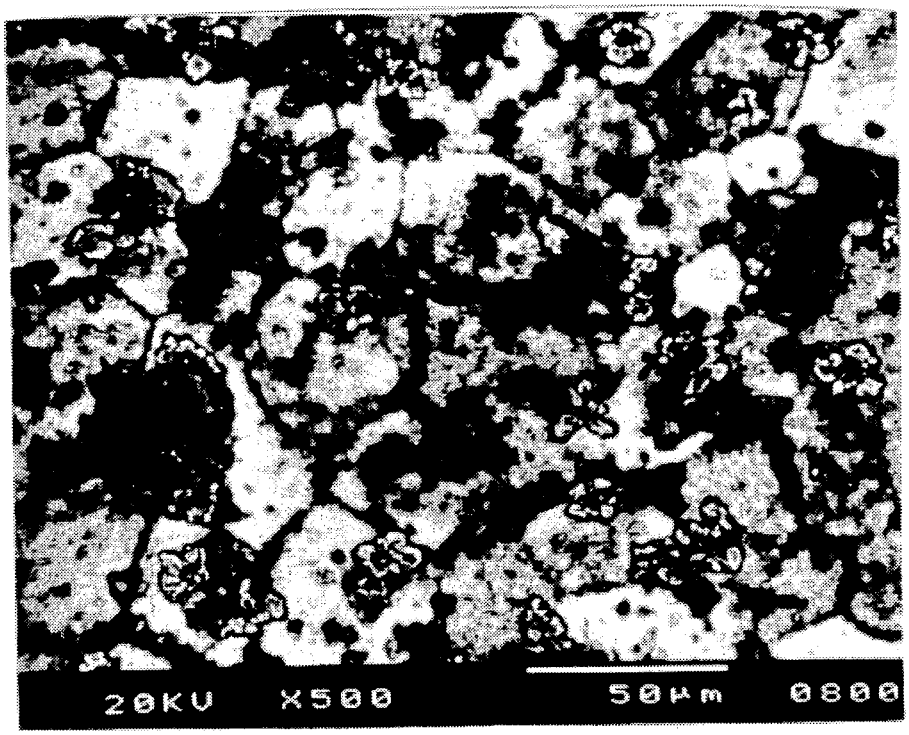
FIG. 4 is an electron micrograph (a back scattered electron image) of the surface of the sample after heat treatment under reduced pressure, of Comparative Example 1.

Cubic samples (5 cells×5 cells×8 mm) were cut out from the sintered honeycomb material and subjected to a heat treatment under reduced pressure under the conditions shown in Table 2. In the heat treatment under reduced pressure, the heating was conducted by using an electric furnace using a tungsten mesh as a heater or by using an induction heating furnace, and the reduced pressure was produced by degassing the furnace inside using a vacuum pump or a diffusion pump, to keep the pressure inside the furnace at a constant vacuum. Each sample after the heat treatment under reduced pressure was examined for pre oxidation amount and oxide film properties. Also, each sample after the heat treatment under reduced pressure was subjected to an oxidation test of keeping the sample in air in an electric furnace of 1,100° C. for 150 hours, to measure the total oxidation amount. The results are shown in Table 2. For reference, the electron micrograph (secondary electron image) of the sample after the heat treatment under reduced pressure, of Example 5 is shown in FIG. 1, and the electron micrographs (back scattered electron images) of the samples after the heat treatment under reduced pressure, of Example 4 and Comparative Example 1 are shown in FIG. 3 and FIG. 4, respectively.

COMPARATIVE EXAMPLE 7

The same sample as used in Examples 1–6 and Comparative Examples 1–6 was subjected to the same oxidation test as in Examples 1–6 and Comparative Examples 1–6, without being subjected to any heat treatment under reduced pressure, to measure the total oxidation amount. The results are shown in Table 2.

COMPARATIVE EXAMPLE 8

Figure 2:
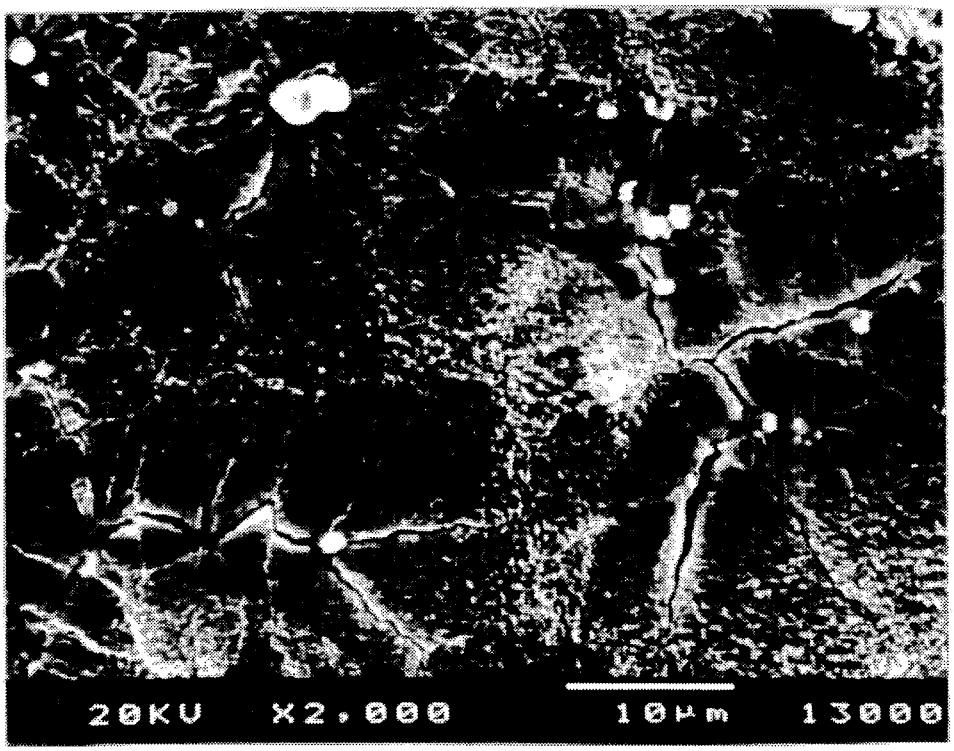
FIG. 2 is an electron micrograph (a secondary electron image) of the surface of the sample after heat treatment in air, of Comparative Example 8.

The same sample as used in Examples 1–6 and Comparative Examples 1–6 was subjected to a heat treatment of placing it in air in an electric furnace using SiC as a heater, at 1,150° C. for 1 hour. The sample after heat treatment was examined for pre oxidation amount and oxide film properties. Also, the sample after heat treatment was subjected to the same oxidation test as in Examples 1–6 and Comparative Examples 1–6 to measure the total oxidation amount. The results are shown in Table 2. For reference, the electron micrograph (secondary electron image) of the sample after heat treatment is shown in FIG. 2.

TABLE 1

| Symbol | Composition (wt. %) Fe | Cr | Al | Si | B | $Y_2O_3$ |
|---|---|---|---|---|---|---|
| A | Remainder | 12 | 10 | 0 | 0.03 | 0.3 |
| B | Remainder | 20 | 5 | 2 | 0.03 | 0.3 |
| C | Remainder | 10 | 10 | 0 | 0.03 | 0.3 |
| D | Remainder | 20 | 5 | 2 | 0.03 | 0 |
| E | Remainder | 10 | 10 | 0 | 0.03 | 0 |

TABLE 2

| | Conditions for heat treatment under reduced pressure | | | | Pre oxidation | Total oxidation | Properties of oxide film formed by heat treatment under reduced pressure |
|---|---|---|---|---|---|---|---|
| | Oxygen partial pressure (Pa) | Total pressure (Pa) | Temperature (°C.) | Time (hr) | amount ($mg/cm^2$) | amount ($mg/cm^2$) | Non-homogeneous portions in oxide film |
| Example 1 | 0.08 | 0.4 | 950 | 15 | 0.07 | 0.72 | Not present |
| 2 | 1.1 | 5.3 | 1060 | 15 | 0.13 | 0.68 | Not present |
| 3 | 1.3 | 6.7 | 1150 | 15 | 0.11 | 0.60 | Not present |
| 4 | 0.02 | 0.1 | 1060 | 15 | 0.06 | 0.64 | Not present |
| 5 | 0.06 | 0.3 | 1150 | 15 | 0.15 | 0.55 | Not present |
| 6 | 1.9 | 9.5 | 1150 | 15 | 0.19 | 0.72 | Partially present |
| Comparative example 1 | 1.1 | 5.3 | 1250 | 15 | 0.40 | 2.33 | Easily seen |
| 2 | 0.02 | 0.1 | 1250 | 15 | −3.90 | 7.00 | Easily seen |
| 3 | 0.001 | 0.005 | 1060 | 5 | 0.01 | 0.82 | Easily seen |
| 4 | 0.001 | 0.007 | 1150 | 5 | 0.04 | 0.97 | Easily seen |
| 5 | 0.002 | 0.009 | 1250 | 5 | 0.18 | 1.20 | Easily seen |
| 6 | 0.1 | 0.5 | 900 | 15 | 0.05 | 0.80 | Easily seen |
| 7 | (Not treated) | — | — | — | — | 0.75 | — |
| 8 | 20000 (in air) | 100000 | 1150 | 1 | 0.11 | 0.75 | Partially present |

| | Properties of oxide film formed by heat treatment under reduced pressure | | | | |
|---|---|---|---|---|---|
| | Cracks in oxide film | Y amount (CPS) surface (B) | Y amount (CPS) Inside (C) | Y concentration ratio (C/B) | W peak in oxide film |
| Example 1 | None | 80 | 260 | 3.3 | w(week) |
| 2 | None | 100 | 180 | 1.8 | n(not present) |
| 3 | None | 100 | 170 | 1.7 | n |
| 4 | None | 80 | 230 | 2.9 | n |
| 5 | None | 60 | 210 | 3.5 | n |
| 6 | None | 90 | 160 | 1.8 | n |
| Comparative example 1 | None | 110 | 120 | 1.1 | n |
| 2 | None | 140 | 140 | 1.0 | n |
| 3 | None | 160 | 110 | 0.7 | n |
| 4 | None | 90 | 110 | 1.2 | n |
| 5 | None | 130 | 120 | 0.9 | n |
| 6 | None | 110 | 150 | 1.4 | s(strong) |
| 7 | — | 100 | 70 | 0.7 | n |
| 8 | Present | 80 | 100 | 1.3 | n |

As is clear from Table 2, each of the samples of Examples 1–6 had a satisfactory protective film after the heat treatment under reduced pressure conducted under the conditions specified by the present invention, and showed excellent oxidation resistance. In contrast, the samples of Comparative Examples 1 and 2 heat-treated at too high a temperature, the sample of Comparative Example 6 heat-treated at too low a temperature, the samples of Comparative Examples 3 and 4 heat-treated at too low a pressure, and the sample of Comparative Example 5 heat-treated at a low pressure and at too high a temperature, distinctly contained non-homogeneous portions in respective protective films and were inferior in oxidation resistance. The sample of Comparative Example 7 subjected to no heat treatment under reduced pressure and the sample of Comparative Example 8 heat-treated in air were inferior in oxidation resistance as well. As seen in FIG. 2, the sample of Comparative Example 8 after heat treatment had a large number of cracks in the protective film.

The yttrium concentration ratios in the samples of Examples 1–6 after heat treatment under reduced pressure, as compared with those in the samples of Comparative Examples 1–6, are greatly high and it is presumed that the enrichment of yttrium in or near film contributes to the increase in oxidation resistance in some form. From the fact that the sample of Comparative Example 6 shows a strong tungsten peak, it is presumed that when the treatment temperature is low, a sample is contaminated and its oxidation resistance is adversely affected thereby.

EXAMPLE 7

A sintered honeycomb material was obtained in the same manner as in Examples 1–6 and Comparative Examples 1–7 except that the honeycomb structure before drying and sintering had dimensions of 50 mm in diameter, 100 μm in rib thickness and 400 cells/in.$^2$ in cell density. The sintered honeycomb material had a shrinkage factor on firing, of 19% and a porosity of 6%. The material had a carbon content of 0.08% by weight when subjected to chemical analysis. A cubic sample (5 cells×5 cells×8 mm) was cut out from the material and subjected to a heat treatment under reduced pressure under the conditions shown in Table 3. In the heat treatment under reduced pressure, the heating was conducted using an electric furnace using a tungsten mesh as a heater, and the reduced pressure was produced by degassing the furnace inside using a diffusion pump, to keep the pressure inside the furnace at a constant vacuum. The sample after the heat treatment under reduced pressure was examined for pre oxidation amount and oxide film properties. Also, the sample after the heat treatment under reduced pressure was subjected to the same oxidation test as in Examples 1–6 and Comparative Examples 1–6, to measure the total oxidation amount. The results are shown in Table 3.

EXAMPLE 8

A sintered honeycomb material was obtained in the same manner as in Example 7 except that a pure Fe powder, a pure Cr powder, a Fe-Al (Al:50% by weight) alloy powder, a Fe-Si (Si: 75% by weight) alloy powder, a Fe-B (B:20% by weight) alloy powder and a $Y_2O_3$ powder were mixed so as to give a composition B shown in Table 1. The sintered honeycomb material had a shrinkage factor on firing, of 20% and a porosity of 9%. The material had a carbon content of 0.14% by weight when subjected to chemical analysis. A cubic sample (5 cells×5 cells×8 mm) was cut out from the materiral and subjected to the same heat treatment under reduced pressure as in Example 7 and the same oxidation test as in Example 7, to measure various test items. The results are shown in Table 3.

EXAMPLE 9

A sintered honeycomb material was obtained in the same manner as in Example 7 except that a pure Fe powder, a pure Cr powder, a Fe-Al (Al:50% by weight) alloy powder, a Fe-B (B: 20% by weight) alloy powder and a $Y_2O_3$ powder were mixed so as to give a composition C shown in Table 1. The sintered honeycomb material had a shrinkage factor on firing, of 18% and a porosity of 8%. The material had a carbon content of 0.08% by weight when subjected to chemical analysis. A cubic sample (5 cells×5 cells×8 mm) was cut out from the materiral and subjected to the same heat treatment under reduced pressure as in Example 7 and the same oxidation test as in Example 7, to measure various test items. The results are shown in Table 3.

EXAMPLE 10

A sintered honeycomb material was obtained in the same manner as in Example 7 except that a pure Fe powder, a pure Cr powder, a Fe-Al (Al:50% by weight) alloy powder, a Fe-Si (Si:75% by weight) alloy powder and a Fe-B (B:20% by weight) alloy powder were mixed so as to give a composition D shown in Table 1. The sintered honeycomb material had a shrinkage factor on firing, of 19% and a porosity of 10%. The material had a carbon content of 0.13% by weight when subjected to chemical analysis. A cubic sample (5 cells×5 cells×8 mm) was cut out from the materiral and subjected to the same heat treatment under reduced pressure as in Example 7 and the same oxidation test as in Example 7, to measure various test items. The results are shown in Table 3.

EXAMPLE 11

A sintered honeycomb material was obtained in the same manner as in Example 7 except that a pure Fe powder, a pure Cr powder, a Fe-Al (Al:50% by weight) alloy powder and a Fe-B (B:20% by weight) alloy powder were mixed so as to give a composition E shown in Table 1. The sintered honeycomb material had a shrinkage factor on firing, of 20% and a porosity of 8%. The material had a carbon content of 0.07% by weight when subjected to chemical analysis. A cubic sample (5 cells×5 cells×8 mm) was cut out from the material and subjected to the same heat treatment under reduced pressure as in Example 7 and the same oxidation test as in Example 7, to measure various test items. The results are shown in Table 3.

COMPARATIVE EXAMPLES 9–13

The same samples as used in Examples 7–11 were subjected to the same oxidation test as in Examples 7–11 without being subjected to the same heat treatment under reduced pressure as in Examples 7–11, to measure their total oxidation amounts. The results are shown in Table 3.

TABLE 3

| | | Conditions for heat treatment under reduced pressure | | | | Pre oxidation |
|---|---|---|---|---|---|---|
| | Composition | Oxygen partial pressure (Pa) | Total pressure (Pa) | Temperature (°C.) | Time (hr) | amount (mg/cm$^2$) |
| Example 7 | A | 0.2 | 1.0 | 1150 | 15 | 0.12 |
| 8 | B | 0.2 | 1.0 | 1150 | 15 | 0.09 |
| 9 | C | 0.2 | 1.0 | 1150 | 15 | 0.20 |
| 10 | D | 0.2 | 1.0 | 1150 | 15 | 0.01 |
| 11 | E | 0.2 | 1.0 | 1150 | 15 | 0.20 |
| Comparative example 9 | A | (Not treated) | — | — | — | — |
| 10 | B | (Not treated) | — | — | — | — |
| 11 | C | (Not treated) | — | — | — | — |

TABLE 3-continued

| | | | | | | |
|---|---|---|---|---|---|---|
| 12 | D | (Not treated) | — | — | — | — |
| 13 | E | (Not treated) | — | — | — | — |

| | Total oxidation amount ($mg/cm^2$) | Properties of oxide film formed by heat treatment under reduced pressure: Non-homogeneous portions in oxide film | Cracks in oxide film |
|---|---|---|---|
| Example 7 | 0.34 | Not present | None |
| 8 | 0.59 | Not present | None |
| 9 | 0.34 | Not present | None |
| 10 | 0.62 | Not present | None |
| 11 | 0.56 | Not present | None |
| Comparative example 9 | 0.66 | — | — |
| 10 | 1.39 | — | — |
| 11 | 0.62 | — | — |
| 12 | 1.19 | — | — |
| 13 | 1.18 | — | — |

As is clear from Table 3, the Fe-Cr-Al alloys having the compositions A to E, when subjected to the heat treatment under reduced pressure according to the present invention to form a protective film as in Examples 7–11, as compared with when subjected to no heat treatment under reduced pressure as in Comparative Examples 9–13, have excellent oxidation resistance.

EXAMPLE 12

Each of the same samples as used in Examples 1–6 and Comparative Examples 1–6 was placed in an alumina pipe (SSA-S) of 15 mm in inside diameter. The alumina pipe was covered, at the both (upper and lower) ends, with a sapphire plate of 27 mm in diameter and 1 mm in thickness. The resulting set was placed in an alumina crucible (SSA-S) with a cover, and a heat treatment under reduced pressure was conducted under the conditions of 1.1Pa (total pressure), 1,150° C. (temperature) and 5 hours (time). In the treatment, the heating was conducted using an electric furnace using a tungsten mesh as a heater, and the reduced pressure was produced by degassing the furnace inside using a diffusion pump to keep the furnace inside at a constant vacuum. After the heat treatment under reduced pressure, the deposit on the lower side of the upper sapphire plate was subjected to elemental analysis using a scanning type electron microscope. As a result, slight amounts of Cr and Fe were detected.

COMPARATIVE EXAMPLE 14

Each of the same samples as used in Example 12 was subjected to the same heat treatment under reduced pressure except that the conditions for the treatment were 0.5 Pa (total pressure), 1,250° C. (temperature) and 15 hours (time). After the heat treatment under reduced pressure, the deposit on the lower side of the upper sapphire plate was subjected to elemental analysis using a scanning type electron microscope. As a result, large amounts of Cr and Fe were detected.

It is appreciated from Example 12 and Comparative Example 14 that when the heat treatment under reduced pressure is conducted at too high a temperature or at too low a pressure, the vaporization of alloy components occurs in large amounts.

As stated above, the method of the present invention enables the formation of a homogeneous protective film of excellent oxidation resistance even on metals of non-homogeneous composition such as Fe-Cr-Al alloy and the like and is very effective for increasing the oxidation resistance of Fe-Cr-Al alloy.

What is claimed is:

1. A method for increasing the oxidation resistance of a Fe-Cr-Al alloy, which comprises placing said Fe-Cr-Al alloy in an atmosphere having an oxygen partial atmosphere of 0.02–2 Pa at a temperature of 950°–1,200° C. to form, on the surface of said alloy, an alumina-based protective film having excellent oxidation resistance.

2. A method according to claim 1, wherein said Fe-Cr-Al alloy is placed in air having a pressure of 0.1–10 Pa at a temperature of 950°–1,200° C.

3. A method according to claim 2, wherein the air pressure is 0.1–7 Pa.

4. A method according to claim 1, wherein the temperature is 1,060°–1,200° C.

5. A method according to claim 1, wherein the alloy is placed in said atmosphere or air for 5–15 hours.

6. A method according to claim 2, wherein the temperature is 1,060°–1,200° C.

7. A method according to claim 2, wherein the alloy is placed in said atmosphere or air for 5–15 hours.

* * * * *